US006237297B1

(12) United States Patent
Paroly

(10) Patent No.: US 6,237,297 B1
(45) Date of Patent: May 29, 2001

(54) MODULAR STRUCTURAL MEMBERS FOR CONSTRUCTING BUILDINGS, AND BUILDINGS CONSTRUCTED OF SUCH MEMBERS

(75) Inventor: Richard Paroly, Harrison, NY (US)

(73) Assignee: IBI, Inc., White Plains, NY (US)

( * ) Notice: Subject to any disclaimer, the term of this patent is extended or adjusted under 35 U.S.C. 154(b) by 0 days.

(21) Appl. No.: 09/223,666

(22) Filed: Dec. 30, 1998

Related U.S. Application Data

(60) Provisional application No. 60/070,003, filed on Dec. 30, 1997.

(51) Int. Cl.[7] ..... E04H 12/00

(52) U.S. Cl. ..... 52/652.1; 52/309.4; 52/337; 52/340; 52/659; 52/650.1; 52/651.01

(58) Field of Search ..... 52/309.4, 337, 52/340, 659, 652.1, 650.1, 651.01

(56) References Cited

U.S. PATENT DOCUMENTS 4,530,191 * 7/1985 Boisbluche ..... 52/309.7
4,611,450 * 9/1986 Chen ..... 52/309.7

* cited by examiner

*Primary Examiner*—Beth A. Stephan
*Assistant Examiner*—Dennis L. Dorsey
(74) *Attorney, Agent, or Firm*—Gottlieb Rackman & Reisman PC

(57) ABSTRACT

A structural member of this class basically consists of two spaced shell panels and an intermediate core. The shell panels may be made of metal or concrete or combinations thereof, or of other rigid materials having the required physical properties. The core is a triangulated wire frame composed of a plurality of zig-zag shaped wire trusses having their sets of top and bottom apexes anchored to associated sets of longitudinal and transverse chords and the respective proximate inside faces of the shell panels. The arrangement of the wire trusses is such that, in each group of three adjacent wire trusses, the middle one has its bottom apexes also connected to the bottom apexes of the wire truss located on one side of the middle wire truss and has its top apexes also connected to the top apexes of the wire truss located on the other side of the middle wire truss.

14 Claims, 6 Drawing Sheets

MODULAR STRUCTURAL MEMBERS FOR CONSTRUCTING BUILDINGS, AND BUILDINGS CONSTRUCTED OF SUCH MEMBERS

RELATED APPLICATION

This application claims priority to U.S. provisional application number 60/070,003 filed Dec. 30, 1997.

FIELD OF THE INVENTION

This invention relates to the art of constructing buildings, especially relatively small and low cost residential, institutional and commercial buildings, utilizing modular prefabricated structural members therefor.

BACKGROUND OF THE INVENTION

Small buildings today are constructed using methods developed before the Industrial Revolution. These types of buildings, as opposed to steel frame building types, are constructed either by cutting up trees into boards of different sizes and nailing the boards together or by erecting stacks of stone or masonry held together with mortar. Historically, such raw materials have been delivered to the construction sites where they are then made into buildings by the process of assembling the cut-up parts of the trees and/or the blocks of stone or masonry into simple "post and beam" type structures the parts of which work independently of one another.

Heretofore, it has been attempted, with a good deal of progress having been made in the more recent past, to achieve factory production of buildings in various forms of modular, panelized and mobile home unit construction, but these never were and still do not represent and embody new technologies; they are simply examples of the same historical "post and beam" technology executed indoors-off-site instead of outdoors-on-site. However, although some cost savings may have been achieved through the use of modern techniques such as bulk raw material purchasing and through the utilization of newer and faster tools, the final products have not only remained basically the same but, because labor and materials are still being used inefficiently, are vulnerable to damage and destruction by fire, hurricanes, earthquakes, moisture and insects.

Building codes, which in the United States serve as minimum standards of construction quality, actually tend to exacerbate these inefficiencies by trying to mandate better quality and greater safety of buildings while anticipating the mediocre labor skills currently found on construction sites. Architects and engineers tend to design buildings in light of the government-specified parameters and then follow up by specifying the use of the already available construction materials and methods. This not only reinforces the use of existing methods but also inhibits innovation in building construction. The construction industry tolerates these disadvantages because a better way has not yet been found and perfected.

The availability and price of lumber have changed drastically over the past decade or so, with availability decreasing and price increasing. The deleterious results of indiscriminate tree cutting are giving rise to alarm over the ecological consequences of global deforestation and have led to great pressure, primarily from environmental groups around the world, on forest products companies and governments to control and slow down such activity. As a consequence, lumber has become increasingly more expensive as distances from source to destination increase transportation costs. Furthermore, skilled craftsmen such as carpenters and masons currently command very high salaries and, even worse, are neither as abundant nor as skilled as they once were. In sum, therefore, small buildings being currently constructed make inefficient use of raw materials, cost more to build, operate and maintain than is necessary, are highly combustible, and are expensive to reinforce to mitigate the threats of fire, earthquakes, hurricanes and floods.

BRIEF DESCRIPTION OF THE INVENTION

The main object of the present invention is, therefore, to provide means for constructing buildings which are constituted principally of a series of novel modular structural members, thereby to enable the aforementioned drawbacks and disadvantages of known building structures and building construction processes to be efficaciously avoided.

It is another object of the present invention to provide a class of novel prefabricated hollow shell-type modular structural members, each of which members includes a triangulated wire core disposed between and secured to a pair of spaced shell panels defining the faces of the structural member, and which members are adapted, in appropriate forms and strengths, for serving as foundations, walls, floors, roofs and partitions of low cost, relatively small buildings.

A related object of the present invention is to provide a class of such modular structural members which, in their manufactured form, are adapted to be easily assembled and interconnected at the construction site so as to define both the structural configuration of the building (including its doors, windows and surface finishes) as well as the infrastructure for its life support systems (including its plumbing systems, electrical systems, heating, ventilation and air conditioning systems, fire protection systems, etc.) as the building is being erected.

It is also an object of the present invention to provide a series of modular structural members as aforesaid which can be used per se either to form a complete self-contained building according to the present invention or to form a part of or an adjunct to an existing building for purposes of renovation and/or expansion, and which can also be used in conjunction with conventional building materials (steel, concrete and wood) to form composite building structures.

Generally speaking, the attainment of the objectives of the present invention is based on a fundamental concept of structure which is incorporated in the modular structural members disclosed herein and which may be briefly described as follows.

The strength of any structure results from a combination of the materials of which it is made and the shape or geometry of those materials. Stated in other words, strength is a function not only of the physical properties of the materials which are used but also of the manner in which they are used, i.e., of their geometric configurations.

A force applied to the top apex of a triangular structure will channel down the two sides of the triangle to the two points or apexes at the bottom. The two points at the bottom of the triangular structure will tend to be pushed outward by that force, i.e., away from each other, unless they are restrained and held in place. It is the bottom member of the triangular structure, of course, which holds those two points in place. This is an efficient system because (1) each member is in either simple tension or simple compression as the force imposed at the top of the triangular structure is resisted by the three members and as the load is transferred to the associated supports, and (2) the connections of the three members can be simple because they do not have to be strong enough to resist turning or bending.

It will also be understood that if several triangular structures are grouped together, the force applied thereto will be distributed throughout an appropriately larger number of members. For example, if a four-sided pyramidal arrangement of triangular structures is used instead of a single triangular structure, the applied force is distributed between eight members instead of three. Such an arrangement obviously increases the efficiency of the system.

It will further be understood that multiple pyramidal arrangements of triangular structures can be interconnected with each other horizontally and vertically as well. In such a system, as the number of connected pyramidal arrangements of triangular structures increases, the forces applied thereto in one area are distributed over a large network of members. Moreover, the individual members need not be very strong, since they work together. Thus, a large number of small members can coact to carry large loads, and by using the same size member repeatedly, a very large structure can be constructed.

In practical applications, the tops and bottoms of such triangular structures either per se or in pyramidal arrangements thereof can be individual members or they can be extensive flat plates. If they are plates, then they can form the solid faces of walls, floors, ceilings and roofs required to enclose building structures and their interior spaces. The plates transmit pressure loads applied to the surfaces of these plates to the network of frame members, in addition to resisting the forces in the top and bottom chords of the pyramids.

By applying the efficiencies of these principles to an entire structure, a building constituted by modular structural members according to the present invention can be made to be much stronger than one constructed by conventional methods. For small to medium-size buildings, the forces at the connections between the modular structural members will be small, which will permit simple connections. Using concrete as a covering for the shell panels of the structural members will result in buildings which will not burn. By applying automated manufacturing techniques to the repetitive nature of a series of essentially identical structural members, an economical system is created which will provide building structures with these major advantages at a lower cost than most current conventional methods.

For the purposes of clarity, by way of definition a building constructed of modular structural members according to the present invention may be considered as consisting of "components", "elements" and "cells". The components are the general working units or building blocks of the desired end product and are used for forming the foundation of the building structure as well as the walls, the floors, the roof and the interior partitions thereof. They are made in large sizes of up to 40 feet by 12.5 feet (12.2 m by 3.8 m) and in thicknesses from 4.5 inches to 1.5 feet (11.4 cm to 45.7 cm). The "elements" are smaller parts of a building including items such as windows, doors, cabinets, closets, and stairs. The "cells" are full building volumes which are factory completed assemblies of components and elements such as entry foyers, bathrooms, and kitchens. In a building structure of the present invention, the components and cells are uniquely interconnected.

The components, elements and cells are designed to enable various materials to work together synergetically to perform the various functions required of the building. The technology underlying and incorporated in the system of the present invention facilitates both low volume manual and high volume automated manufacturing applications.

The components, i.e., the various modular structural members, are all fabricated from the same basic materials and by the same techniques. Each component has a block-like form which consists of two spaced parallel shell panels defining the sides and faces of the block and of an inner portion or core between the shell panels. In all components, the core between the associated two shell panels basically consists of a triangulated wire frame to which the shell panels are secured. To the extent there are any differences between some of the components, these differences are in the structural strengths, the architectural design details, and the thermal performance properties of the components.

The structural strength of each component varies by virtue of differences in the triangulation, the thickness, and the nature and strength of the material of which the "wire" of the wire frame is made (the material used for the "wire" may be steel, structural plastic, or any other comparable linear material); the material strength of the shell panels; and the depth or thickness of the component. The wire frame consists of zig-zag shaped wire "trusses" placed next to each other in the space between the shell panels and having their tips or apexes connected. The arrangement in particular is such that in each group of three adjacent wire trusses, the middle one thereof has its bottom apexes connected to the bottom apexes of the wire truss located on one side of the middle wire truss and has its top apexes connected to the top apexes of the wire truss located on the other side of the middle wire truss.

In addition, at each of the inside faces of the shell panels bounding the core-accommodating space therebetween, there are provided a set of mutually parallel first wire cables or chord members each of which extends along and is connected to the apexes of a respective one of the wire trusses in a direction parallel to the longitudinal axis of the wire core, and a set of likewise mutually parallel second wire cables or chord members each of which extends perpendicular to the first chord members and is connected thereto at irs intersections with the first chord members and the respective apexes of the various wire trusses. A plurality of anchors located at those intersections connect the chord members and the apexes of the wire trusses to the shell panels.

The shell panels can be made from a variety of materials including concrete, metal, combinations thereof, or other rigid panel material. The most typical is a layer of concrete into which the anchors are embedded. The concrete layer, which is about 2 inches (5.1 cm) thick, may be reinforced with plastic fibers and may additionally be reduced in weight by being transformed into cellular concrete through the incorporation therein of many small air bubbles or a cellular plastic foam. The shell casting material may vary in strength from 150 to 4,000 pounds per square inch (psi) in density from 30 to 120 pounds per cubic foot, as well as in insulating properties. These different shell panel characteristics result from variations in the proportions of the ingredients of the shell mixture that includes cement, sand, reinforcing fibers, and cellular foam. The shell panels are formed to provide the final exposed finish and texture thereof and, in conjunction with the wire frame core, to impart to the modular structural members the required structural load-bearing capacity.

For certain conditions, a metal shellpan may be embedded in the concrete shell panel. The shellpan is designed to provide additional strength, so as to enable the component to accommodate ducts or conduit for electrical wiring or to accommodate reinforcements for openings, holes to receive fasteners at the positions of various life support system parts, etc.

The thickness or diameter of the wire used to form the wire trusses varies from ⅛ inch (0.32 cm) to ½ inch (1.3 cm), and its strength varies further according to the strength of the material from which the wire is made. Moreover, as already pointed out, the apexes of the wire truss triangles are fastened to the perpendicularly intersecting first and second chord members and jointly therewith to the shell panels (and, where applicable, to the shellpans as well). The completed wire frame thus is a deep, three dimensional, open "mesh" consisting of interconnected triangulated shapes formed by small diameter lightweight wire. As a result, the shell panels and the wire frame members all work together to transfer and resist the forces acting on the various components.

The overall depth or thickness of the structural members will vary from 4½ inches (11.4 cm) in the case of a partition-forming component to 16 inches (40.6 cm) in the case of a large floor-forming component. Typically, as the depth increases, the wire size or thickness of the wire trusses will also increase. The greater depth, of course, increases the capacity of the structural member to resist loads perpendicular to its face (e.g., wind load for walls, floor load for floors, snow load for roofs).

Each modular structural member according to the present invention, therefore, becomes a complete, structurally integral unit. A wall-forming structural member or component actually performs structurally as a large beam (the height of a wall). Tension loads (pulling up on walls) thus are resisted by the entire length of the wall since, the stress from any one point is to be distributed throughout the entire wall-forming component by the interior wire frame. Correspondingly, a floor-forming component acts as a two way-slab spanning up to approximately 24 feet (7.3 m). As such, they are less vulnerable than conventional structures to failure when a section of continuous support is lost, such as due to foundation failure. The substantial portion of structural material is positioned on the outer faces of the component where the greatest efficiency can be attained in all conditions, including the most demanding ones.

In a finished building, furthermore, where the components are connected, the floor-forming components are connected to and supported by the wall-forming components in a way that is different from typical comparable structures. Floors of most conventional structures are supported on beams or joists which themselves are simply supported at their ends by the walls. While the walls do their job supporting the floor load which is brought to them by the floor, they do not help the floor in its job of supporting the weight of the floor load. The floor-forming components in a building according to the present invention are connected to the wall-forming components in a way that enables the walls to help the floor carry its load. The top and bottom shell panels of the floor-forming components are connected to the wall-forming components in a fashion establishing a moment connection between them.

More particularly, in the system of the present invention, at the regions of the floor-to-wall connections the triangulation of the wire trusses, i.e., the spacing of adjacent wire trusses from each other as well as the spacing of adjacent apexes thereof from each other, in the wall-forming components is more compact, which makes the connections stronger and helps the floor-forming component resist its tendency to bend under the load. Each such floor-to-wall connection is continuous along the entire perimeter of the floor-forming component. This substantially increases the load-bearing capacity of the floor-forming components as well as the wind load-bearing capacity of the wall-forming components. For example, engineering calculations indicate that the load-bearing capacity of an 18.8 square foot floor-forming component increases from 60 to 90 pounds per square foot by this connection method.

Furthermore, this changes the nature of the entire assembled structure. Instead of the building being an assembly of independent pieces (studs, joists, or blocks), it becomes a complete whole structural element. This provides excellent resistance to earthquakes, hurricanes and floods.

BRIEF DESCRIPTION OF THE DRAWINGS

The foregoing and other objects, characteristics and advantages of the present invention will be more clearly understood from the following detailed description when read in conjunction with the accompanying drawings, in which.

DETAILED DESCRIPTION OF THE INVENTION

Figure 1:
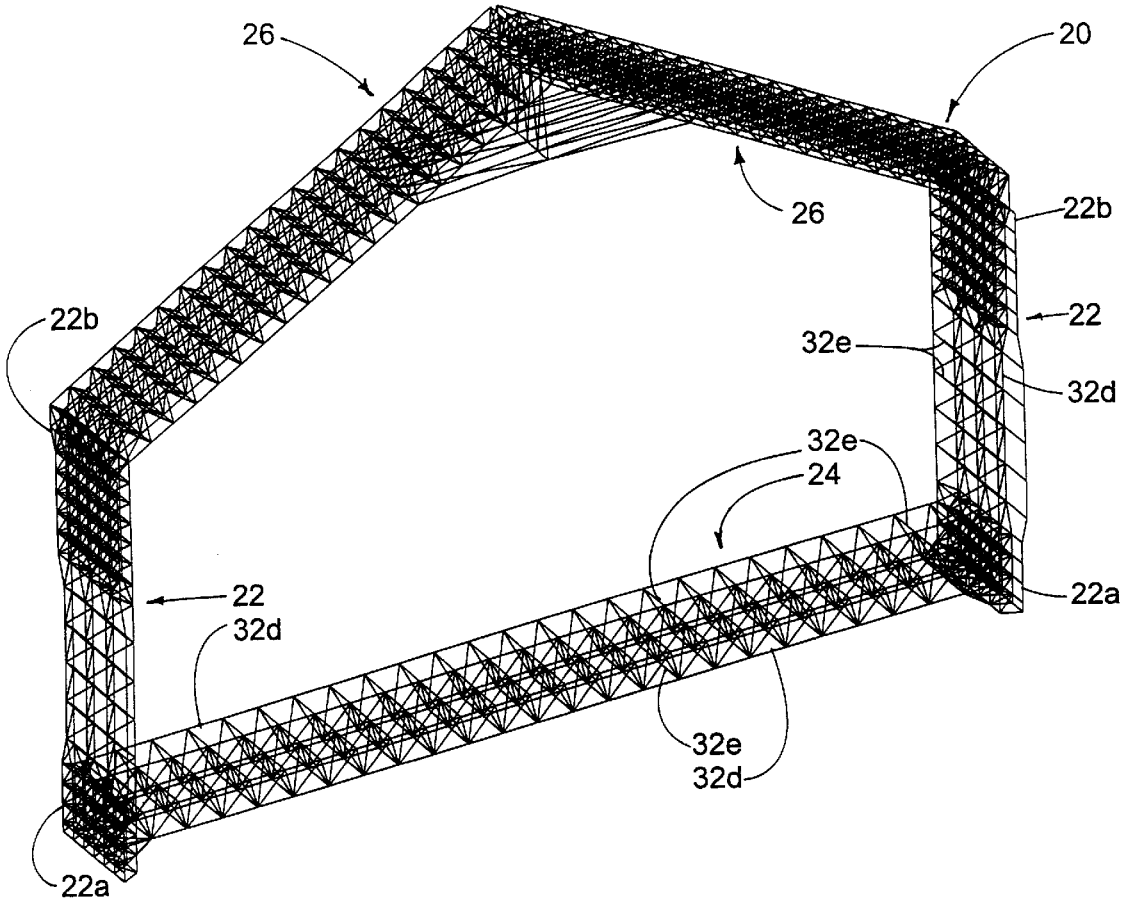
FIG. 1 is a schematic illustration, in perspective, of a section of a building structure according to the present invention and shows a group of modular structural members constituting two wall components, a floor component and two roof components, the various components being shown in the form of their triangulated wire cores only and without their associated shell panels.
Figure 2:
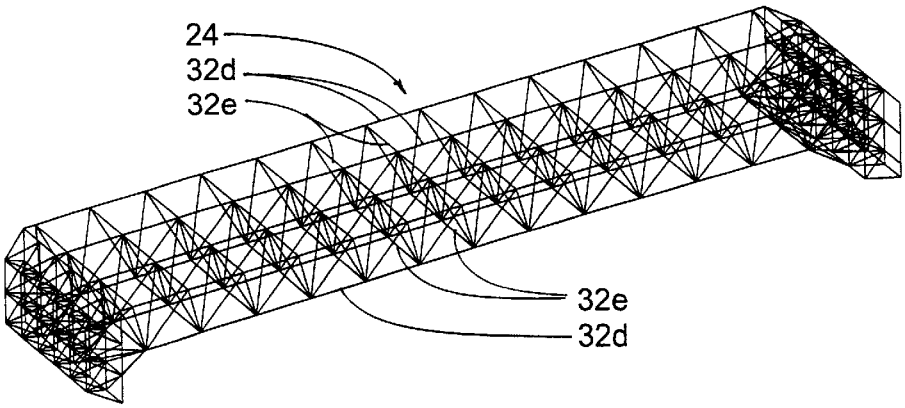
FIG. 2 is a perspective illustration, on a somewhat enlarged scale, of the floor component, without its shell panels, constituting a part of the building structure shown in FIG. 1.
Figure 8:
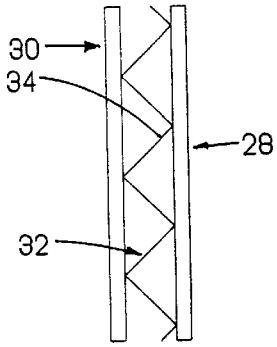
FIG. 8 is a schematic cross-sectional view of a modular structural member according to the present invention and illustrates the same as constituted of two separate shell panels spaced from but connected to each other by a triangulated wire core.
Figure 9:
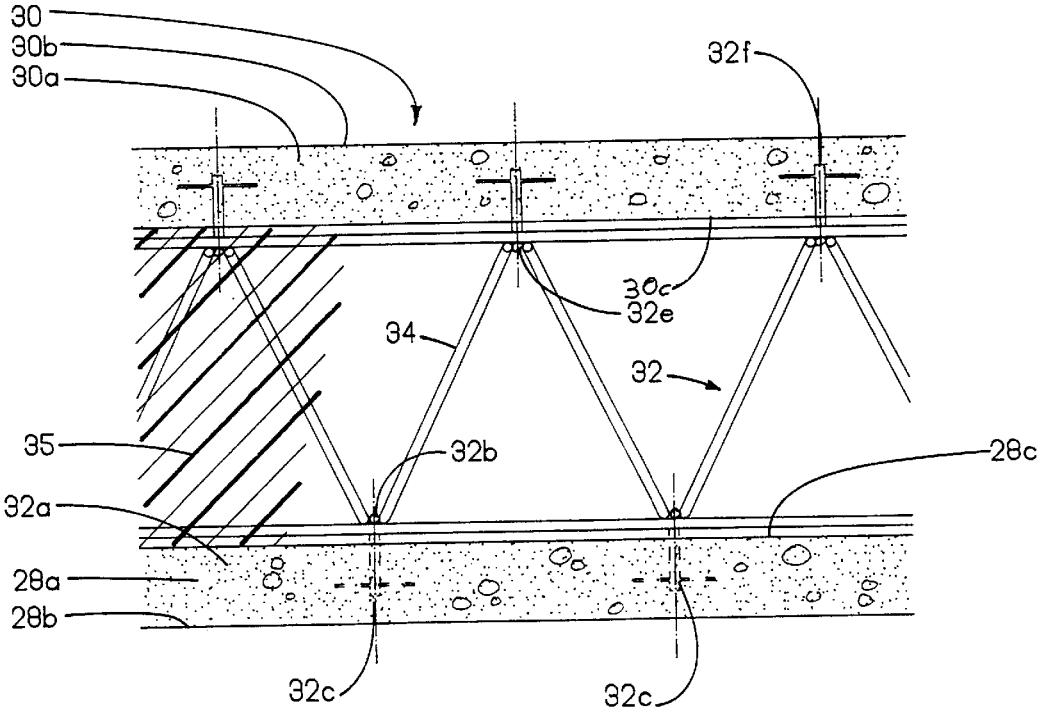
FIG. 9 is an enlarged representation of a section of the structural member shown in FIG. 8 and illustrates certain details thereof.

Referring now to the drawings in greater detail, a section of a gabled-roof building structure 20 is shown in FIG. 1 as being constructed of a multiplicity of modular structural members according to the present invention (obviously only a small number of them are shown) which constitute wall components 22, floor components 24 (see also FIG. 2), and roof components 26 of the building structure. Although only arrangements of triangulated wires are shown in these views, each of the various structural members 22, 24 and 26 actually has the form of a block composed, as shown in FIGS. 8 and 9, of a pair of shell panels 28 and 30 separated from one another by a space 31 and connected to one another by an intermediate triangulated wire core 32 located in the space 31. The shell panels have been omitted from FIGS. 1 and 2 for the sake of simplicity. For ease of identification, furthermore, the shell panels 28 and 30 are hereinafter occasionally referred to as the interior shell and the exterior shell, respectively.

In the preferred embodiment of the invention, the shell panels 28 and 30 have the form of respective layers 28*a* and 30*a* of concrete. If deemed advisable for a particular type of building structure, a respective metal reinforcing plate or shellpan (not shown) may be embedded in each layer of concrete over substantially its entire expanse for enhancing the strength and fire resistance of the shell panels 28 and 30 individually and thereby of the structural members 22, 24 and 26 composed thereof as well. Alternatively, however, the shell panels may be made of metal or other sufficiently strong and fire-resistant materials. In the illustrated embodiment, furthermore, certain adjuncts of the triangulated wire core 32, shown in FIG. 9 and more fully described hereinafter, are also embedded in the layers of concrete and constitute means by which the shell panels 28 and 30 and their associated wire core are connected to each other. In the illustrated embodiment, furthermore (see FIG. 9), the outer face 28*b* of the interior shell 28 is that face thereof which in use is directed toward and defines the boundary wall surface of the associated enclosed building space, while the outer face 30*b* of the exterior shell 30 is that face thereof which in use is directed away from the enclosed building space. The inner faces 28*c* and 30*c* of the interior and exterior shells of a building component are, of course, those faces of the shells which are directed toward each other and between which the space 31 and the triangulated wire core 32 are located.

Figure 4:
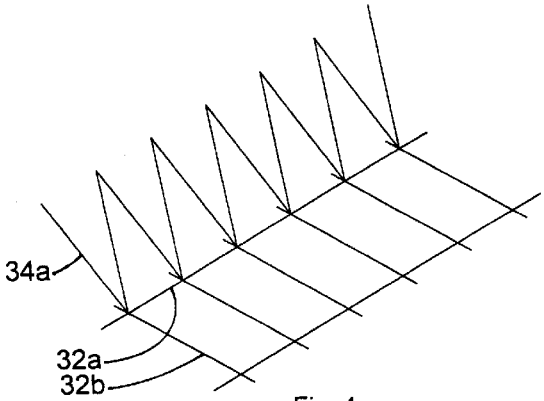
FIG. 4 is a diagrammatic illustration of a first stage of the formation of the triangulated wire core of a modular structural member according to the present invention, this view showing the positioning of the first zig-zag shaped wire truss for the core of the structural member.
Figure 5:
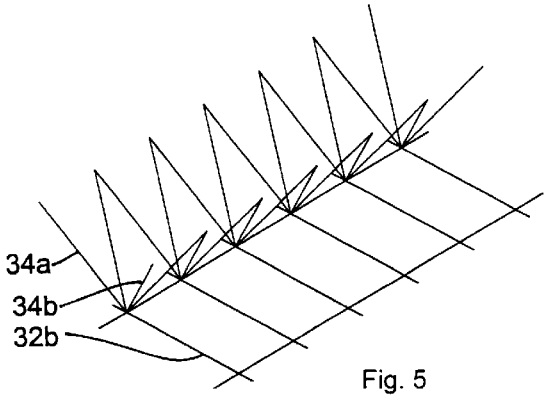
FIG. 5 is a diagrammatic illustration of the second stage of the formation of the triangulated wire core of a modular structural member according to the present invention, this view showing the positioning of the second zig-zag shaped wire truss relative to the first wire truss.
Figure 6:
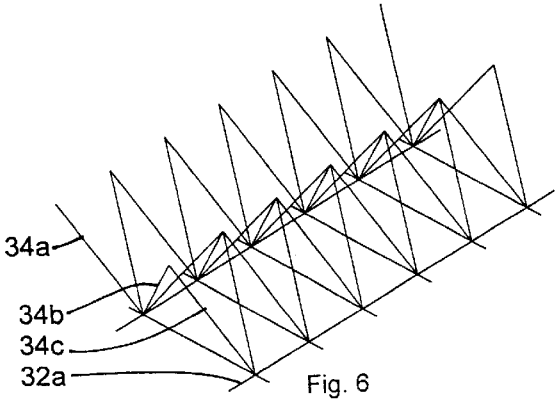
FIG. 6 is a diagrammatic illustration of the third stage of the formation of the triangulated wire core of a modular structural member according to the present invention, this view showing the positioning of a third zig-zag shaped wire truss for relative to the second wire truss.

Referring now to FIGS. 4, 5 and 6, according to the present invention the triangulated wire core 32 of the basic structural members 22, 24 or 26 consists, as previously indicated, of a plurality of zig-zag shaped wire elements or "trusses" 34 placed next to each other across the width of the structural member, with their tips or apexes interconnected. To prepare such a core, a group of mutually parallel first wire cables or chord members, designated 32*a* in FIG. 9, are laid out in a suitable jig or fixture (not shown) so as to extend in a direction parallel to the intended longitudinal axis of the wire core, and a group of mutually parallel second wire cables or chord members, designated 32*b* in FIG. 9, are laid out in the same fixture crosswise over the first chord members.

A first zig-zag wire truss 34*a* (FIG. 4) is then arranged along a first one of the longitudinal wire chord members 32*a* in a substantially upright position in a plane which is slightly inclined relative to the vertical plane of the first longitudinal chord member in a direction away from the next adjacent longitudinal chord member, with the bottom vertices or apexes of the first wire truss 34*a* located at respective intersections of the first longitudinal chord member with the cross chord members. A second zig-zag wire truss 34*b* (see FIG. 5) is then placed next to the first wire truss 34*a*, with the bottom vertices of the second truss being located at the same intersections between the underlying longitudinal and cross chord members 32*a* and 32*b* as the bottom vertices of the first truss and with all those elements at each intersection being connected to each other by means of suitable anchor members. Thereafter, a third zig-zag wire truss 34*c* (see FIG. 6) is placed next to the second wire truss, with the bottom vertices of the third truss being located away from the bottom vertices of the second truss and along a separate longitudinal chord member 32*a* but with the top vertices or apexes of the third truss 34*c* being located adjacent to the top vertices of the second truss.

The procedure is then continued as needed in the same fashion as described so far, until a core structure 32 of the desired length and width has been built up. It will be understood that care must be taken to ensure that in any group of three directly adjacent wire trusses across the width of the core structure, the middle one of those wire trusses has its bottom apexes connected only to the bottom apexes of the wire truss located on one side of the middle wire truss and has its top apexes connected only to the top apexes of the wire truss located on the other side of the middle wire truss. At that stage, an additional group of longitudinal chord members 32*d* and an additional group of cross chord members 32*e* are put in place on top of the assembled wire trusses, with the intersections of those chord members being positioned over the top apexes of the wire trusses, and the top apexes of the wire trusses together with the underlying intersecting longitudinal and cross chord members are connected to each other by respective sets of anchor members 32*f*. Where the structural member is to include a shellpan within each of the concrete shell panels, it is further contemplated that the shellpans will be positioned across the entire expanse of the wire core structure at both faces thereof and hence in contact with the apexes of the wire trusses, for enabling the shellpans to be welded to the wire trusses and to the intersections of the longitudinal and cross chord members.

Figure 3:
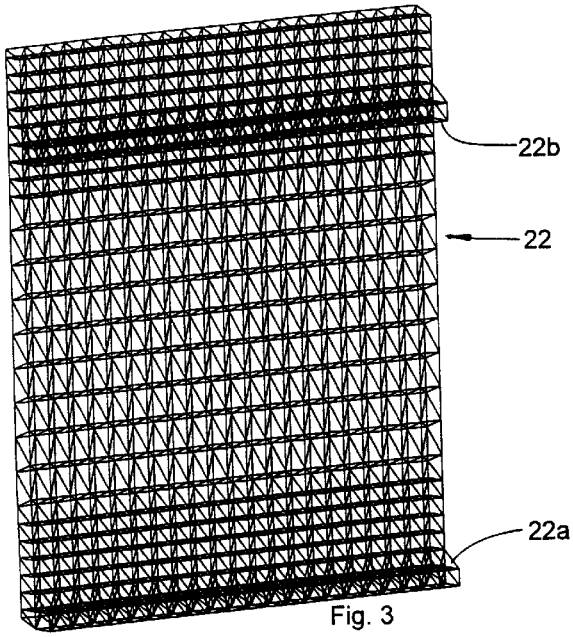
FIG. 3 is an elevational illustration, in perspective and on a reduced scale, of one of the wall components, without its shell panels, constituting a part of the building structure shown in FIG. 1, the wall component being illustrated as provided with vertically spaced horizontal compacted regions of its triangulated wire core designed for supporting respective floor components.
Figure 3A:
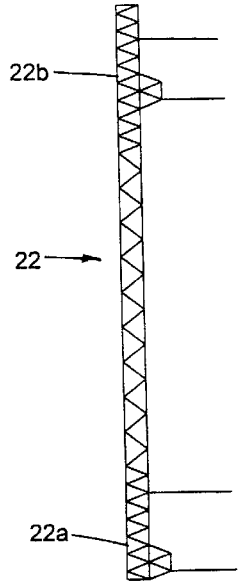
FIG. 3A is a schematic side edge view of the triangulated wire core structure of the wall component shown in FIG. 3.

Attention is called to the fact that, although the arrangement of the zig-zag shaped wire trusses in a triangulated wire core for a modular structural member according to the present invention is normally uniform over the entire expanse of such member, that arrangement is modified somewhat, as shown in FIGS. 3 and 3A, in the case of the floor-to-wall connection region of a wall-forming component. For that situation, each wall-forming component 22 is provided with a more compact distribution of the wire trusses 34 at each level 22*a*, 22*b*, etc., where it is to be connected to a floor-forming component 24. The narrower spacing of the adjacent wire trusses from each other and the narrower spacing of the adjacent apexes of each wire truss from each other, both of which are clearly visible in FIG. 3A, in conjunction with the fact that each floor-to-wall connection is continuous along the entire perimeter of the floor-forming component, ensures that the connections are stronger and helps the floor-forming component resist its tendency to bend under the load. This substantially increases the load-bearing capacity of the floor-forming components as well as the wind load-bearing capacity of the wall-forming components.

Reverting now to the assembly of the structural member, once the wire core structure 32 is complete, the opposite face regions of the core structure are introduced into a mold (this may be effected either simultaneously or sequentially, depending on the type of equipment available and on existing production requirements) which has the desired contours of the two shell panels 28 and 30. Concrete, preferably admixed with air bubbles or a cellular plastic foam, is then poured into the mold and permitted to set so as to form the layers 28*a* and 28*b* with the grids of longitudinal and cross chord members 32*a*–32*b* and 32*d*–32*e* and the sets of anchors 32*c* and 32*f* embedded in the concrete and held firmly in place.

Figure 7:
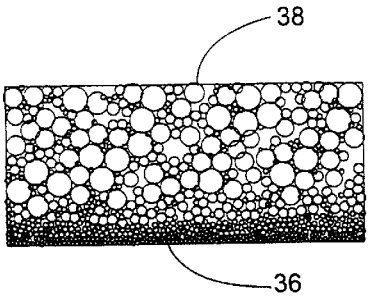
FIG. 7 is a schematic sectional representation of a layer of cellular concrete used as a part of the shell panel of a modular structural member according to the present invention and illustrates the provision of collapsed air cells in the layer of concrete adjacent the outer surface of the shell panel.

It should be noted at this point that the durability and the water resistance of the structural members or components 22, 24 and 26 will be primarily a function of the surface density of the concrete utilized in the shell panels 28 and 30. Durability, strength and water resistance of concrete advantageously increase with density, yet thermal values, fire performance characteristics, weight and cost decrease with higher densities. To take advantage of this property of the concrete, vibrations can be applied at the surface region 36 of the shell mixture (see FIG. 7) where the forms are in contact with the mixture, which results in a collapse of the air cells at that surface region while the air cells in the region 38 away from that surface remain fully expanded. Vibrations can also be transmitted into the mixture through the steel wire core structure to increase the density of the concrete at the juncture between the metal and the concrete. In this way, a density of the concrete which is in general correct for a particular component or structural load can be maintained without increasing it to address a surface requirement. This is especially useful for floor components and for the exterior faces of outside wall and roof components.

In this regard, it is well known that whereas rain and snow are one source of water problems for buildings, another one is condensation. The transmission of cold to the warm side of standard (non-cellular) concrete causes condensation to form on the warm side. Cellular concrete has thermal characteristics which are superior to standard concrete and, therefore, it assists in resisting the formation of moisture on the insides of wall and roof components. Experience with buildings indicates, however, that even when proper steps have been taken to resist water penetration, provision must nonetheless still be made for the escape of moisture which may accumulate. To this end it is contemplated by the present invention to design the shellpans incorporated in the concrete shell panels so as to include channels for directing moisture to holes through which it can escape.

It should also be noted that even though the basic structure of the wall, floor and roof components of the present invention is the same, there will nevertheless be some differences between certain ones of such components in terms of their structural strengths, architectural design details, and thermal performance. For example, it may be deemed advisable to provide an outside wall component or a roof component of a building structure with a thermal insulation material 35 (see FIG. 9) within the space 31 between the shell panels 28 and 30 occupied by the triangulated wire core. On the other hand, an inside wall component or a floor component of the building structure may not require as much insulation or, for that matter, may not require any insulation at all.

Figure 10:
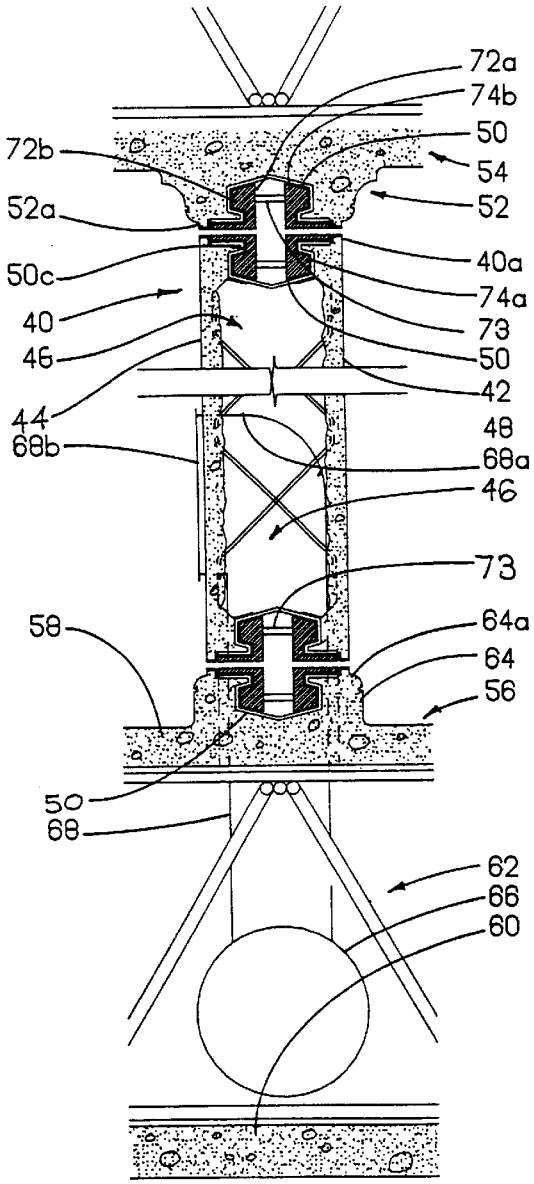
FIG. 10 is a vertical section taken through a part of a building structure according to the present invention constituted of a vertical wall or partition component extending between and connected at its top and bottom edges to two associated vertically spaced floor/ceiling components, the section being taken along a plane located in front of a duct riser incorporated in the wall or partition component.
Figure 11:
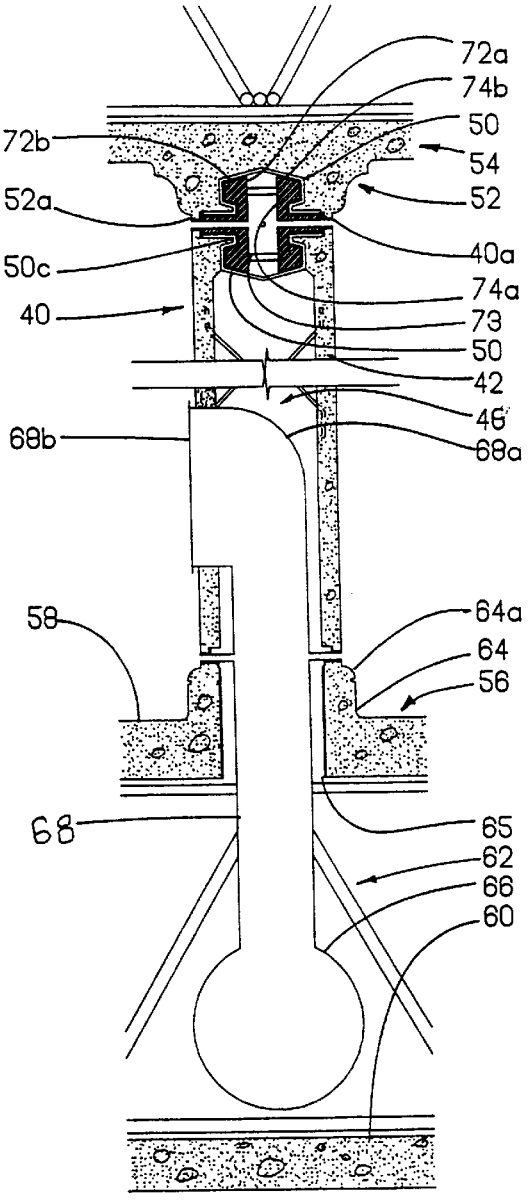
FIG. 11 is a sectional view similar to FIG. 10 but with the section being taken along a plane located axially of the duct riser incorporated in the wall or partition component.
Figure 14:
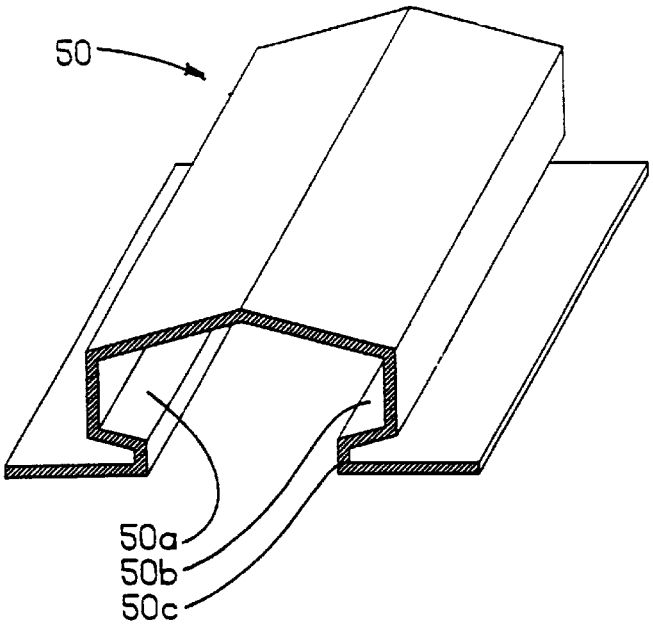
FIG. 14 is an enlarged perspective illustration of a channel-shaped female connector member constituting a part of the joint shown in FIGS. 12 and 13.

A practical example of an interconnection of a partition (inside wall) component between a ceiling and a floor is illustrated by FIGS. 10 and 11. As there shown, the partition component 40 is a block-shaped structure composed of a pair of spaced parallel concrete shell panels 42 and 44 which are connected to each other by a triangulated wire core 46 disposed in the space between the shell panels. Set into the molded concrete top and bottom edges 40*a* and 40*b* of the partition component are respective upwardly and downwardly open identical female connector channels 50 of the type shown in FIG. 14, the function of which will be more fully explained presently. Above the top edge 40*a* of the partition component there is located a downwardly projecting molded concrete ceiling ledge or molding 52 which has a bottom edge 52*a* aligned with the top edge 40*a* of the partition component 40 and supporting a molded-in downwardly open female connector channel 50 identical to the one in the partition component. The ceiling ledge 52 is shown as depending from a ceiling component 54 which could be either an adjunct of a roof component (not shown) or an adjunct of an upper floor component (not shown).

Correspondingly, located below the bottom edge 40*b* of the partition component 40 is a floor component 56 which, like the partition component, is composed of two spaced parallel concrete shell panels 58 and 60 connected to each other by a triangulated wire core 62. Here again, the floor component 56 could be the lowest level of the building structure or its bottom panel could be the ceiling component of a lower room. In a fashion similar to that of the ceiling component 54, the floor component 56 has an upwardly projecting ledge or molding 64 the top edge 64*a* of which is aligned with the bottom edge 40*b* of the partition component and has an upwardly open molded-in female connector channel 50. As an illustration of a utilitarian use of the partition component other than as a space divider, there is provided in the floor component a duct 66, for example, for conducting a heating or cooling fluid from a source thereof, and a duct riser 68 is shown as ascending from the duct 66 through a sleeve-lined opening 65 in the floor component 56 (FIG. 11) into the interior of the partition component and terminating after a lateral bend 68*a* in a discharge end 68*b* outside the partition component and covered by a suitable register or grille.

Figure 15:
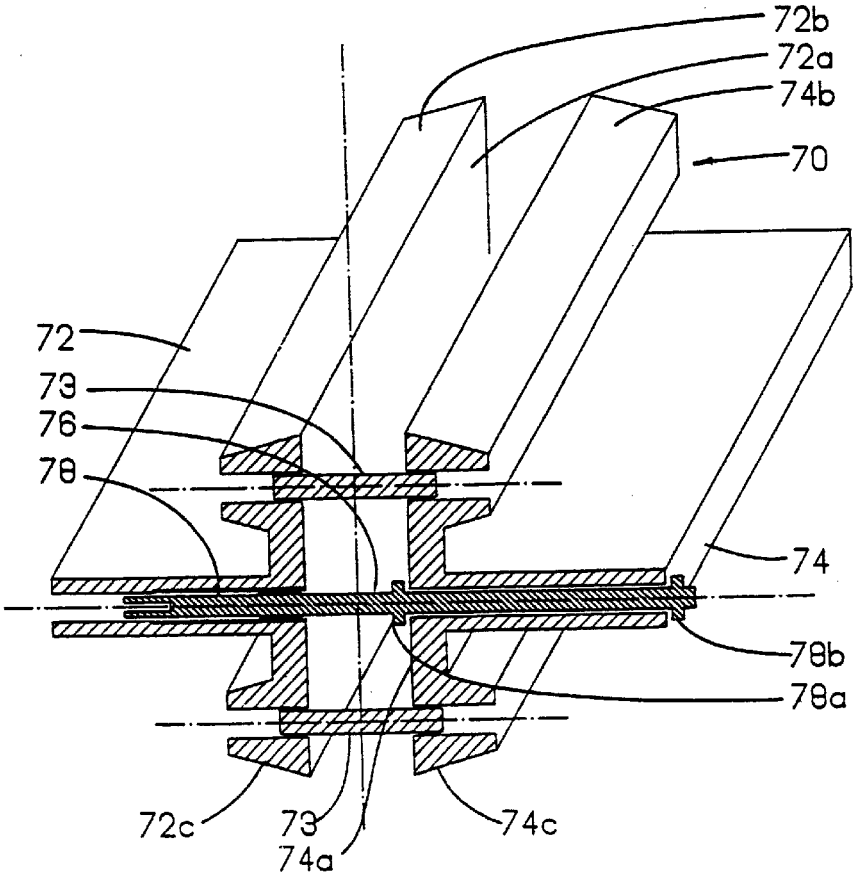
FIG. 15 is an enlarged perspective illustration of the activated and expanded male connector member of the joint shown in FIGS. 12 and 13.

The interconnection of the partition component 40 with the ceiling and floor ledges 52 and 64 is effected with the aid of a set of identical expansible/contractible male connector elements 70, which correspond in shape to the connector channels 50 and in a more refined form are of the type shown in FIG. 15. As there shown, each male connector element includes two jaw-like members 72 and 74 which have flat proximal faces 72*a* and 74*a* and are arranged, with the aid of guide pins 73, to be linearly displaced toward and away from each other by means of a screw drive shaft 76 which is rotatably received in an internally threaded bore or sleeve 78 carried by the member 72 and is provided with a pair of spaced lateral projections 78*a* and 78*b* bracketing the ends of the shaft-receiving bore in the member 74. The jaw-like members 72 and 74 further have identical upper parts in the form of ridges or ribs 72*b* and 74*b* of generally trapezoidal cross-section which project away from one another, and identical lower parts in the form of ridges or ribs 72*c* and 74*c* of generally trapezoidal cross-section which project away from one another, all such ribs or ridges being configured to fit into respective lateral recesses 50*a* and 50*b* (FIG. 14) of an associated one of the female connector channels 50. The open mouth 50*c* of each connector channel is sufficiently wide to permit passage of the contracted male connector element 70. In the system of FIGS. 10 and 11, therefore, when both of the male connector elements 70 are expanded as shown in FIG. 10 (the upper male connector element in FIG. 11 is contracted), they cannot be extracted from the respective connector channels 50, whereby the partition component 40 is securely locked to the upper ceiling component 54 as well as to the lower floor component 56.

Figure 12:
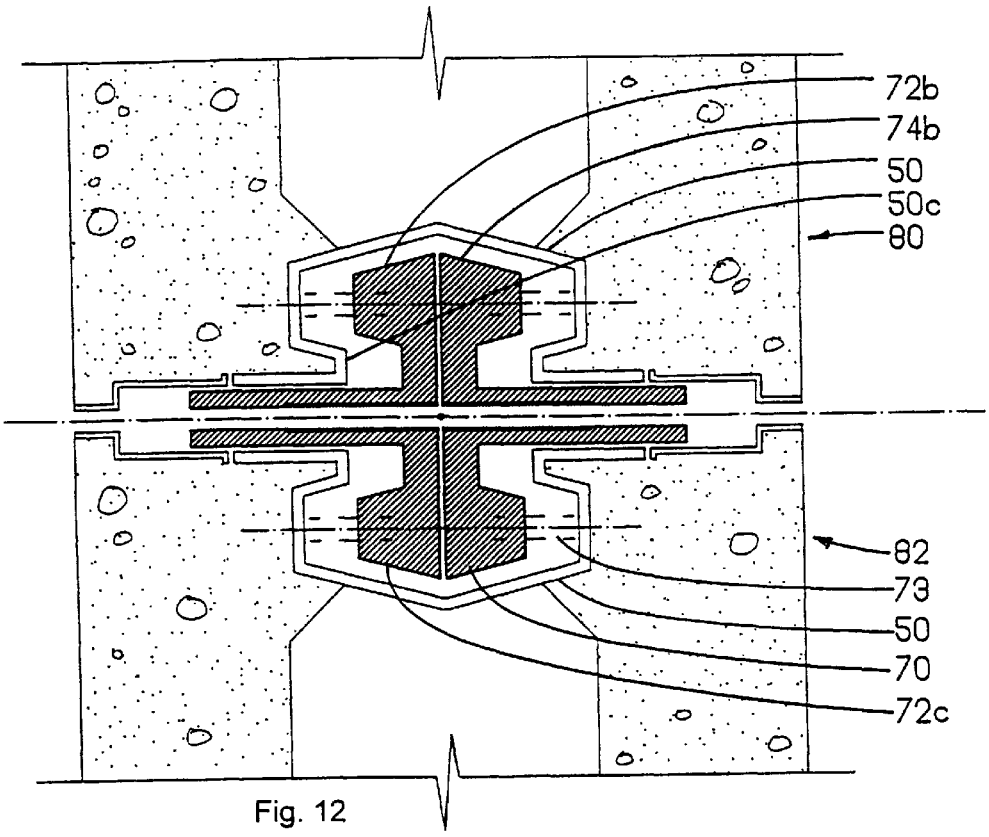
FIG. 12 is an enlarged horizontal section through the connection region between the abutting vertical side edges of two horizontally aligned wall components and illustrates the interfitted male and female connector members of the joint (these are the same as the ones shown in FIGS. 10 and 11) prior to the activation and expansion of the male connector member of the joint.
Figure 13:
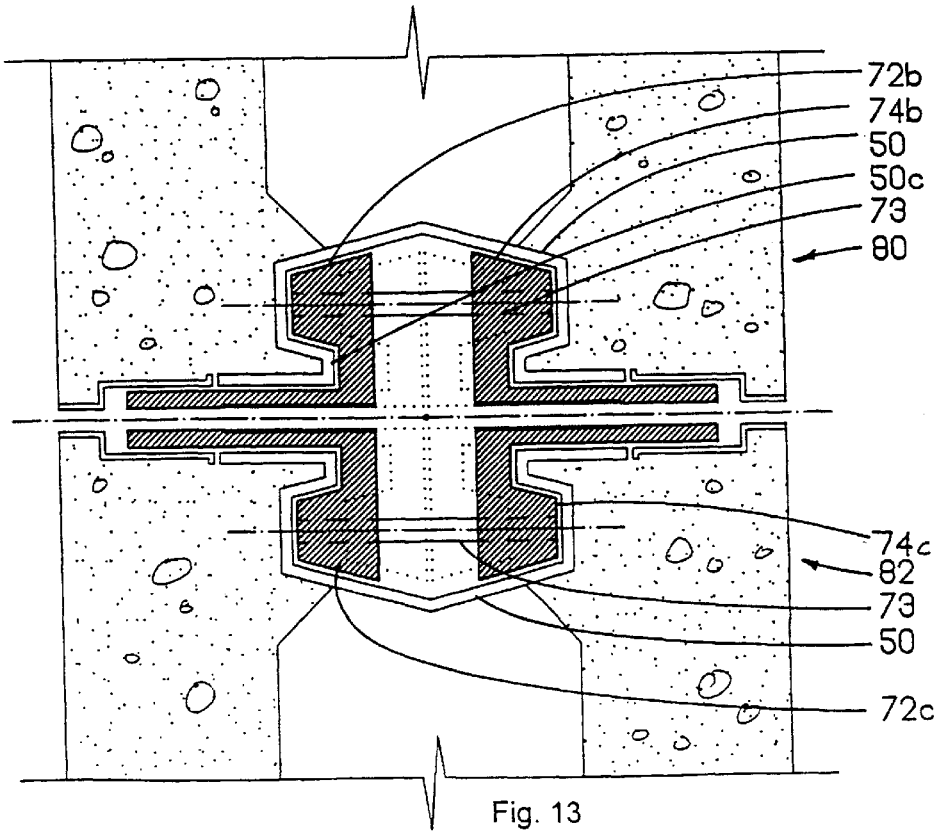
FIG. 13 is a view similar to FIG. 12 but illustrates the male connector member of the joint after its activation and expansion in the female connector member of the joint.

FIGS. 12 and 13 represent a connection between the vertical edges of two horizontally aligned and abutting exterior wall components 80 and 82. The connection is, however, effected in exactly the same way, utilizing two confronting female connector channels 50 and a two-part expandable/contractable male connector element 70, as the connections shown in FIGS. 10 and 11, the only difference being that in the system of FIGS. 10 and 11 the connection is vertical between two horizontal abutting edges whereas in the system of FIGS. 12 and 13 the connection is horizontal between two vertical abutting edges. Accordingly, a more detailed description of the connection shown in FIGS. 12 and 13 is not believed necessary.

It will be understood that the foregoing description of the present invention is for purposes of illustration only, and that the various structural and operational features herein disclosed are susceptible to a number of modifications and changes none of which entails any departure from the spirit and scope of the present invention as defined in the hereto appended claims.

What is claimed is:

1. A modular structural member for use as a part of a building structure, comprising:

(a) a pair of spaced, parallel shell panels and a core interposed between and secured to said shell panels for retaining the latter in their spaced relationship;

(b) each of said shell panels having outside and inside faces which are directed away from each other and of which said outside face provides an exposed finish and texture for said structural member; and (c) said core comprising a triangulated wire frame composed of a plurality of zig-zag shaped wire trusses running alongside one another between two opposite boundary edges of said structural member and extending from one of said boundary edges to the other, each of said zig-zag shaped wire trusses having bottom and top apexes each of which is connected to the respective proximate one of said shell panels at said inside face thereof, and in each group of three adjacent wire trusses, a middle one thereof has its bottom apexes also connected to said bottom apexes of the wire truss located on one side of said middle wire truss and has its top apexes also connected to said top apexes of the wire truss located on the other side of said middle wire truss.

2. A structural member according to claim 1, further comprising adjacent each of said inside faces of said shell panels a respective plurality of mutually parallel first chord members arranged at the locations of the junctures between said shell panels and said top and bottom apexes of said zig-zag shaped wire trusses of said triangulated wire frame, a respective plurality of mutually parallel second chord members arranged transverse to said first chord members and located at the locations of the intersections between said first chord members and said top and bottom apexes of said wire trusses, and a plurality of anchors located, respectively, at the intersections between said first and second chord members and connecting said first and second chord members and said top and bottom apexes of said wire trusses to said shell panels.

3. A structural member according to claim 1 or 2, wherein each of said shell panels is made of metal.

4. A structural member according to claim 1 or 2, wherein each of said shell panels is made of concrete.

5. A structural member according to claim 1 or 2, wherein each of said shell panels is made of concrete incorporating a quantity of cellular plastic foam.

6. A structural member according to claim 1 or 2, wherein each of said shell panels is made of concrete reinforced by a quantity of plastic fibers.

7. A structural member according to claim 1 or 2, wherein each of said shell panels is made of concrete reinforced by a quantity of plastic fibers and incorporating a quantity of cellular plastic foam.

8. A structural member according to claim 1 or 2, wherein each of said shell panels is made of a layer of concrete having a metal shellpan embedded therein and substantially coextensive in area with said layer of concrete, thereby to enhance the strength of said structural member for enabling it to accommodate conduits, openings and fasteners.

9. A building structure having at least a part thereof constructed of at least one structural members as claimed in claim 1 or 2.

10. A building structure having at least a part thereof constructed of at least one structural member as claimed in claim 8.

11. A modular structural member for use as a part of a building structure, comprising:

a triangulated wire frame composed of a plurality of zig-zag shaped wire trusses running alongside one another between two opposite boundary edges of said structural member and extending from one of said boundary edges to the other, each of said zig-zag shaped wire trusses having bottom and top apexes which are connected to others of said top and bottom apexes, and in each group of three adjacent wire trusses, a middle one thereof has its bottom apexes connected only to said bottom apexes of the wire truss located on one side of said middle wire truss and has its top apexes connected only to said top apexes of the wire truss located on the other side of said middle wire truss.

12. A structural member according to claim 11, further comprising respective pluralities of mutually parallel first chord members arranged at the locations of said top apexes and of said bottom apexes of said zig-zag shaped wire trusses of said triangulated wire frame, respective pluralities of mutually parallel second chord members arranged transverse to said first chord members and located at the locations of the intersections between said first chord members and said top and bottom apexes of said wire trusses, and respective pluralities of anchors located, respectively, at the intersections between said first and second chord members and interconnecting said first and second chord members and said top and bottom apexes of said wire trusses.

13. A structural member according to claim 12, wherein said triangulated wire frame has said top and bottom apexes of said wire trusses arranged at predetermined substantially uniform spacings from each other.

14. A structural member according to claim 13, wherein said triangulated wire frame has at least one region thereof in which said top and bottom apexes of said wire trusses are arranged at spacings from each other which are smaller and more compact than said predetermined spacings.

* * * * *